US005110426A

United States Patent [19]

Boutin et al.

[11] Patent Number: 5,110,426

[45] Date of Patent: May 5, 1992

[54] METHOD OF AND AN APPARATUS FOR INTRODUCING AT LEAST ONE HALIDE IN THE LIQUID OR GASEOUS STATE INTO THE BATH OF A CELL FOR DRY ELECTROLYSIS

[75] Inventors: Jean Boutin, Argenteuil; Pierre Brun; Airy-Pierre Lamaze, both of Grenoble; Patrick Paillere, Ugine; Pascale Salles, Avrille, all of France

[73] Assignee: Compagnie Europeenne Du Zirconium Cezus, Courbevoie, France

[21] Appl. No.: 582,089

[22] Filed: Sep. 14, 1990

[51] Int. Cl.[5] ..... C25C 3/02

[52] U.S. Cl. ..... 204/64 R; 204/64 T; 204/245; 204/246; 204/270; 204/272; 204/275

[58] Field of Search ..... 204/246, 247, 258, 260, 204/270, 64 R, 64 T, 128, 245, 275, 272

[56] References Cited

U.S. PATENT DOCUMENTS 2,908,619 10/1959 Barnett ..... 204/246
2,913,378 11/1959 Dean et al. ..... 204/64 T
2,975,111 3/1961 Reimert et al. ..... 204/64 T

*Primary Examiner*—John Niebling
*Assistant Examiner*—Arun S. Phasge
*Attorney, Agent, or Firm*—Dennison, Meserole, Pollack & Scheiner

[57] ABSTRACT

A method of, and an apparatus for, introducing at least one halide into the bath of cell for dry electrolysis. The method confines a portion of the bath in an annular space and upward motion is imparted to the confined portion of the bath by introduction of a gas and halide into the annular space. The apparatus for carrying out the method consists of two concentric tubes: an inner tube through which the halide and the gas are introduced and which tube is open at its bottom end and which tube has orifices on its lateral wall; and an outer tube which is open at its bottom end, closed at the top end and provided on its lateral wall with apertures situated at a level higher than that of the orifices. The method and apparatus can be applied to the operation and construction of electrolysis baths in which the concentration by weight of the halide and its mean valency must be maintained within a narrow range and be able to be adjusted progressively and precisely.

12 Claims, 1 Drawing Sheet

METHOD OF AND AN APPARATUS FOR INTRODUCING AT LEAST ONE HALIDE IN THE LIQUID OR GASEOUS STATE INTO THE BATH OF A CELL FOR DRY ELECTROLYSIS

The invention relates to a method of an an apparatus for introducing at least one halide in the liquid or gaseous state into the bath of a cell for electrolysis in the dry way.

A man skilled in the art knows that it is possible to obtain deposition of a metal by introducing one of its derivatives, such as a halide for example, into a molten salt bath and subjecting it in the simplest way to the action of two electrodes connected to the poles of a direct current source: the halogen is given off at the anode and the metal is deposited at the cathode. This technique, which is referred to as dry electrolysis, has been the subject of many studies and has terminated in the conception of various methods and apparatuses which differ from one another, particularly from the point of view of the way the halide is introduced into the bath.

Indeed, this operation is particularly delicate, especially when the halides involved are those of multivalent metals and is calls for certain precautions if one is to arrive at a regular and homogeneous dissolution of the said halide and avoid the violent variations in concentration and valency which are the cause of sludge formation, clogging or puncturing of the diaphragm separating the anolyte from the catholyte, resulting in a poor quality of deposited metal and, if the phenomenon persists or is repeated, to shut down of the installation due to destruction of the diaphragm or accumulation of sludge.

For example, among the prior art techniques, U.S. Pat. No. 4,113,584 may be cited which relates especially to the production of titanium by dry electrolysis, where introduction is carried out by means of a supply cathode 28 which is partially immersed in the bath and inside which there is a tube 11*a* through which $TiCl_4$ arrives, possibly accompanied by argon, to ensure blending of the chloride or of a solid metallic compound with the bath; this cathode is closed at its bottom part and at the level of the end 12*a* of the pipe 11*a* by a basket 14*a*, the porosities in which are carefully calculated. This basket, which reduces the $TiCl_4$ to a lower valency must be maintained in a narrow range of levels of electrical voltage or otherwise the pores of the basket become clogged or, in contrast, the basket degrades under the effect of electrochemical corrosion. Under these conditions, dissolution of the chloride reduced in the bath is performed irregularly and may even give rise to sludge formation. This then results in a variation in the halide in the bath in terms of both concentration and valency which, via fluctuations in behaviour of the diagram, results in an heterogeneous deposition of metal and a low Faraday efficiency.

In GB 1579955, likewise concerned with the production of titanium by dry electrolysis, there is also an electrolytic prereduction of the $TiCl_4$ by means of a cathode 3 which is bell-shaped and which is immersed in the bath and inside which there is a tube 4 through which the halide, possibly accompanied by argon, is introduced; this tube is likewise provided with fins which, by rotating, make it possible to agitate the bath 2. The reduced material 15 is deposited on the inside of the cathode 3 and is displaced by the fins to be dispersed in the bath and so saturated. This method therefore calls for mechanical agitation; furthermore, the seeking after saturation inevitably causes the presence of sludge and makes it necessary to work at predetermined concentrations and valency states, which means a lack of flexibility in the exploitation of this method.

In U.S. Pat. No. 4,588,485 which describes a method of obtaining metal by the electrolysis of halides, there is likewise a cathode 14 which is basket-shaped and which consists of a metal grid suspended in the bath, comprising two coaxial cylinders and surmounted by a halide feed system 19. Circulating in this basket is a current $I_2$ which must be carefully monitored to avoid any clogging or puncturing of the basket. In the event of such a problem arising, it is necessary to modify $I_2$ and the outcome is necessarily a fluctuation in both concentration and valency of the halide in the bath. Furthermore, if it is desired to make progressive adjustments of concentration and/or valency, it is only possible to do so within the functional limits of the basket.

It is with a view to resolving these drawbacks that the Applicants have sought and found a means by which they can firstly control the levels of concentration and valency of the halide introduced and thus minimise any imbalance in the bath resulting from such introduction, and on the other carry out progressive and controlled adjustments of concentration and/or valency.

This method of introducing at least one halide in the liquid or gaseous state into the bath of a dry electrolysis cell in which there are at least partially immersed an anodic assembly and a cathode between which a direct electrical voltage is created and into which the halide is introduced at the same time as an inert gas is characterised in that a portion of the bath is confined in an elongate annular volume on an axis which is substantially vertical and which communicates with the bath via its ends and imparts to the volume, with the help of the introduced halide and gas, a movement which is upwards inside the volume and downwards on the outside.

Thus, the invention resides in continuously or intermittently introducing an inert gas into the bath simultaneously with the halide and in confining the bath volume with which it initially comes in contact. This produces the following phenomena: the gas, having a far smaller volumetric mass than that of the bath and not being readily soluble in this latter, forms bubbles which rise to the surface. On account of the fact that the portion of the bath which is initially in contact with the gas is confined in the form of a stream but has the possibility of moving in a substantially vertical direction, the ascent of the bubbles induces in the confined space a movement whereby the bath moves in the same direction. The outcome is a downwards thrust on the bath situated outside the said space and hence a continuous circulation and continuous renewal of the bath, i.e., recycle of the volume constitutring the bath, in contact with the gas and the halide, as it moves upwardly through the annular space. Thus there is a regular dissolution of the halide and hence relatively slight fluctuations in concentration in relation to the mean concentration of the bath and slight fluctuations in valency if the stream is negatively polarised in such a way as to cause a reduction in the halide introduced.

It is preferably to use the continuous introduction in such a way as to minimise the fluctuations in concentration and valency.

Preferably, the bath movement is such that more than two renewals per hour are assured, but the best results are obtained when the range of renewals is between five and twenty.

Furthermore, over and above 50 renewals of the bath per hour, the quantity of inert gas needed produces excessive volatilisation of the bath.

The ascending motion of the gas is preferably carried out with a ratio of gas volume to gaseous halide volume of between 0 and 5 under the working temperature conditions of the bath.

The invention likewise relates to an apparatus for carrying out the above-described method. This apparatus consists of two concentric tubes immersed at least partially into the bath and separated from each other by the said bath: an inner tube open at its ends and in which the halide and the inert gas circulate from the top downwardly, an outer solid walled tube closed at its top end and open at its bottom end, and it is characterised in that the wall of the inner tube comprises orifices situated in its lower part and at a level higher than the end of the outer tube, the wall of the outer tube comprising apertures situated at a level which is higher than that of the orifices.

Thus, the apparatus according to the invention which comprises an outer tube with a solid wall and apertures is distinguished from the apparatuses described in U.S. Pat. Nos. 4,113,584 and 4,588,485 in which the said tube comprises a porous wall and in GB 1579955 in which the tube has no apertures in its upper part.

The particular configuration obtained by the invention ensures the confinement of a portion of the bath and allows the gas in combination with the orifices in the inner tube to produce circulation of the bath and its continuous renewal in contact with the halide.

Preferably, the total area of the apertures is greater than that of the annular space separating the tubes in order to allow the bath to move easily.

Furthermore, in order to have a sufficiently long period of dissolution of the halide in the bath, it is preferable for the length of the confined zone to be fairly substantial in relation to its width, resulting in a ratio of minimum spacing between apertures to the orifices to the distance separating the tubes of between 1 and 20 and preferably of between 2 and 10.

Similarly, a compromise is chosen between the number of orifices and their diameters which favours both the formation of small gas bubbles and their passage towards the confined space. The height of the confined bath space is linked to the height of the bath in the cell, so that preferably the depth of immersion of the tubes is comprised between one-third and two-thirds the height of the bath.

One particular feature of the invention lies in fitting the bottom end of the inner tube with slots which may supplement the role played by the orifices and increase the rate of circulation of the bath, if needed for special operations.

For certain halides of multivalent metals, it is preferable to introduce them in a state of valency which is lower than that of the halide supplied and which generally corresponds to the overall valency of the bath. In this case, the outer tube is polarised negatively in order to ensure in the confined bath space an electrochemical reduction of the halide, such reduction being furthermore accelerated by the movement of the bath and encouraging the production of slight fluctuations in the said valency at the moment of introduction. The effect of this polarisation is ideal when reduction of the halide does not result in suspended metal sludge or deposited metal, which can be avoided by maintaining the density of the polarising current below a limit value. In the case of the multivalent metals exemplified here, this limit is generally around 0.05 A/sq.cm. Therefore, the outer tube or the whole of the apparatus will be so dimensioned that this limit is observed within the envisaged operating conditions.

BRIEF DESCRIPTION OF THE DRAWING

The invention will be more clearly understood from the attached FIG. 1 which shows a semi-sectional view in the longitudinal direction of the apparatus placed in a bath.

The drawing more particularly shows an outer tube 1 immersed in the bath indicated diagrammatically by 2, the said outer tube being closed at the top and open at the bottom and having a wall in which there are three apertures 3 situated a little below the level of the bath.

Figure 1:
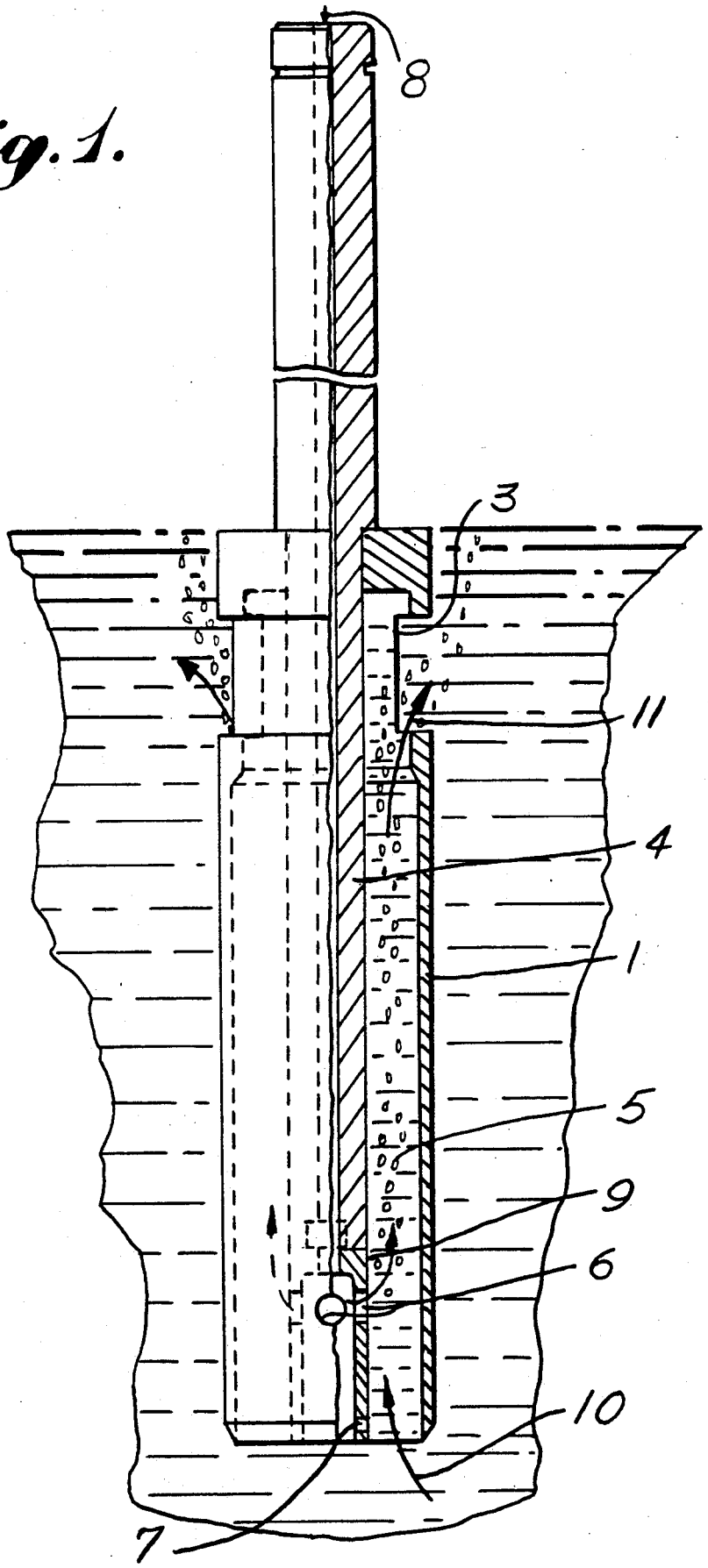

Associated with this tube is a concentric inner tube 4, the bottom end of which is at the same level as that of the other tube but the top end of which is extended beyond it. The two tubes define between them a space 5 filled by the bath and the inner tube is provided towards the bottom with two rows of four holes 6 and at its end with slots 7. The tubes 1 and 4 may be electrically insulated to allow negative polarisation of the outer tube and partial reduction of the halide introduced, but this insulation is not apparent in the drawing.

In operation, the liquid or gaseous halide and inert gas mixture is introduced at the top of the inner tube as indicated by the arrow 8. Under the effect of the temperature of the tube which is heated by the bath, the halide vaporises and forms with the gas a mixture which escapes through the holes 6 in accordance with the arrow 9 into the space 5 causing an ascending movement of the bath through the bottom part of the outer tube as indicated by the arrow 10. While it is rising, the halide dissolves in the bath and is possibly reduced to a state of lower valency if the apparatus is connected to a negative current source. The bath recharged with halide escapes from the outer tube through the apertures 3 as indicated by the arrow 11 while the gas bubbles burst at the surface of the bath. Thus there is an upwards circulation of the bath in the apparatus and a downwards circulation on the outside, ensuring an homogeneous distribution of the halide in terms of both concentration and valency.

The invention may be illustrated by means of the following examples of application:

EXAMPLE 1

The method and the apparatus according to the invention have been applied to the introduction of niobium chloride $NbCl_5$ into a dry electrolysis cell of parallelepiped form defining an inner base surface of length 700 mm and width 500 mm which contained over a height of 500 mm approx. 270 kg of a molten salt bath maintained at 725° C. and composed of an equimolecular mixture of NaCl-KCl and 5% by weight of NaF.

Immersed in this bath were two cathodes with a surface area of 300×300 mm supplied at a current density of 0.18 A/sq.cm. Parallel with these cathodes and between them was placed a diaphragm enclosing an anode 150 mm in length in which a current of density 0.6 A/sq.cm was circulating.

At the moment when electrolysis was commenced, the bath contained 0.5% by weight Nb with a mean valency of 3.2. Then, 140 g/h of niobium in the form of gaseous $NbCl_5$ were introduced into a current of argon of 40 l/h at normal temperature (in other words respectively volumes of 123 l/h and 146 l/h at 725° C.) using two apparatuses according to the invention situated in the plane of the anode at a distance of 50 mm from this latter and 50 mm from the wall of the cell and formed by an interior tube with an outside diameter of 26 mm and provided at about 80 mm from the bottom with two rows of four holes measuring 1.2 mm in diameter, and an outer tube with an inside diameter of 80 mm. These tubes consisted of graphite and plunged into the bath to a depth of 380 mm. The outer tube was negatively polarised to pass a current of density 0.042 A/sq.cm and corresponding to 1.8 Faradays per mole of $NbCl_5$ introduced.

In this way, it was possible to achieve an induced bath circulation at a rate of flow close to 1 cu.m/h corresponding to about seven bath renewals per hour and the resulting fluctuation in concentration in terms of weight of Nb between the inlet and the outlet of the apparatus was 0.9% relative, the variation in valency being 0.6% relative. The variations in concentration and valency of the bath were not measurable in operation at equilibrium over one hour, i.e.:

in valency: fluctuation $<0.05$ (limit of detection)

in concentration: fluctuation $<0.02\%$ weight (limit of detection).

With a conventional supply means employing bubbling, not polarised, the respective fluctuations over an hour were comprised:

in concentration, between $\pm 0.05$ and 0.1% by weight in valency between 0.1 and 0.3.

with an introduction efficiency of less than 70%.

EXAMPLE NO. 2

The production of titanium was carried out in a cell identical to that of the previous example, containing an equimolar bath of NaCl, KCl maintained at 725° C., the same anodes and cathodes and the same injectors.

The current density on the cathodes was 0.144 A/sq.cm and on the anode 0.48 A/sq.cm. The tubes of the apparatuses were polarised to a current density of 0.035 A/sq.cm, the total current corresponding to 1.9 Faradays per mole of $TiCl_4$ introduced.

Initially, the bath contained 2% by weight of titanium with an average valency of 2.1.

Then 143 g/h of $TiCl_4$ in the liquid state was introduced, which vaporised during the course of its path through the apparatus under argon. The relative variations obtained between the inlet to and the outlet from the apparatus were 0.23% by weight for concentration and 0.91% for valency.

The concentration and valency variations of the bath under established conditions were not detectable over one hour.

EXAMPLE 3

By way of comparison, the injection apparatus according to the invention was replaced by an apparatus of the type described by U.S. Pat. No. 4,113,584, in other words an introduction cathode of which the porous immersed part consisted of a 100 mesh nickel cloth covered with electrolytic nickel until the resultant values were obtained in terms of electrical coefficient and flux:

$$0.34 < Cd < 0.35$$

$$0.18 < Cf < 0.185$$

determined by the precise procedures described in the above-mentioned patent.

Once functioning of this cathode was established, the following results were obtained:

current density needed to avoid clogging or puncturing: variable between 0 and 0.12 A/sq.cm relative variations in concentration and value between the inside and outside of the cathode:

concentration 265% valency 52% in other words concentration comprised between 1.2 and 5.3% and a valency comprised between 1.9 and 3.2.

We claim:

1. A method of introducing an inert gas and at least one liquid or gaseous halide into a bath contained within an electrolysis cell in which there are at least partially immersed an anodic assembly and a cathode between which a continuous electrical voltage is established and into which the halide is introduced at the same time as an inert gas, comprising the steps of:

(a) providing a means for confining a portion of the bath in an annular elongate space on an axis which is substantially vertical and which space at its upper and lower ends is in communication with the bath; and (b) imparting motion to the bath in the annular space by introduction of the liquid or gaseous halide and the inert gas to effect an ascending motion of the bath in the annular space and a descending motion of the bath on the outside of the annular space, whereby a continuous circulation of the bath in contact with the gas and or the halide is achieved.

2. A method according to claim 1, wherein the ascending motion effects at least two recycles per hour through the annular space of the volume of the bath.

3. A method according to claim 2, wherein the ascending motion effects between five and twenty recycles of the bath per hour.

4. A method according to claim 1, wherein the ratio of volume of gas to the volume of gaseous halide under the temperature conditions of the bath is between 0 and 5.

5. A method according to claim 1, wherein the halide is reduced electrochemically when it is introduced into the bath.

6. An apparatus for introducing an inert gas and at least one liquid or gaseous halide into a bath contained within a dry electrolysis cell and comprising means for confining a portion of the volume of the bath, said means comprising two vertically disposed concentric tubes which are separated from each other to define an annular space therebetween confining the portion of the bath, one of said two tubes being an inner tube (4) open at its ends for introduction of the halide and the inert gas to circulate them from the top downwardly, the other of said two tubes being an outer tube (1) having a solid wall closed at its top end and open at its bottom end, the wall of the inner tube being provided with orifices (6) adjacent its lower end at a level higher than the end of the outer tube, and the outer tube having a wall provided with apertures (3) vertically spaced from the orifices and at a level higher than that of the orifices.

7. An apparatus according to claim 6, wherein the total area of the apertures is greater than that of the annular space which separates the tubes.

8. An apparatus according to claim 6, wherein the ratio of the minimum vertical distance separating the orifices from the apertures and the distance which separates the tubes to provide the annular space is comprises between 1 and 20.

9. An apparatus according to claim 8, wherein the ratio is comprised between 2 and 10.

10. An apparatus according to claim 6, wherein the concentric tubes are positioned in the cell at a depth between on-third and two-thirds the height of the bath in the cell.

11. An apparatus according to claim 6, wherein the inner tube is provided at its bottom end with slots (7).

12. An apparatus according to claim 6, wherein the outer tube is negatively polarised.

* * * * *